US005675651A

United States Patent [19]

Bailleux et al.

[11] Patent Number: 5,675,651

[45] Date of Patent: Oct. 7, 1997

[54] METHOD FOR TRANSMITTING INFORMATION BETWEEN A COMPUTERIZED CONTROL CENTER AND A PLURALITY OF ELECTRONIC FRANKING MACHINES

[75] Inventors: Jean-Philippe Bailleux, Sartrouville; Claude Martin, Saint Germain en Laye, both of France

[73] Assignee: SECAP, Boulogne Billancourt, France

[21] Appl. No.: 517,868

[22] Filed: Aug. 22, 1995

[30] Foreign Application Priority Data

Sep. 1, 1994 [FR] France ..... 94 10530

[51] Int. Cl.[6] ..... H04K 1/00

[52] U.S. Cl. ..... 380/23; 380/4

[58] Field of Search ..... 380/23, 24, 25, 380/4

[56] References Cited

U.S. PATENT DOCUMENTS 4,436,992 3/1984 Simjian .

FOREIGN PATENT DOCUMENTS

| | | |
|---|---|---|
| A-0 151 874 | 8/1985 | European Pat. Off. . |
| A-0-328 057 | 8/1989 | European Pat. Off. . |
| A-0-390-731 | 3/1990 | European Pat. Off. . |
| A-29 16 2007 | 11/1980 | Germany . |
| 2 173 738 | 10/1986 | United Kingdom . |
| A-2 251 210 | 1/1992 | United Kingdom . |

*Primary Examiner*—David C. Cain

*Attorney, Agent, or Firm*—Kenyon & Kenyon

[57] ABSTRACT

A method uses portable objects where the reading and writing of data in the memory are free, owing to the writing in the latter, if necessary, of elements which can be prepared and verified only if secret information kept both in a secure memory at the control center and in a secure memory in the machine with which the transmission is carried out is known.

10 Claims, 3 Drawing Sheets

METHOD FOR TRANSMITTING INFORMATION BETWEEN A COMPUTERIZED CONTROL CENTER AND A PLURALITY OF ELECTRONIC FRANKING MACHINES

BACKGROUND OF THE INVENTION

The present invention concerns electronic franking machines which are dependent upon a computerized control center.

It is known that franking machines have various counters, in general at least one so-called up counter, the value of which, at each franking impression, is increased by the amount of the latter, and a so-called down counter, the value of which is decreased by the franking amount, the value of the up counter representing the total sum of the frankings printed by the machine since it was put into service while the value of the down counter indicates the credit not yet consumed since the last reloading of the machine with monetary units.

Numerous methods have already been proposed to allow the control center, when it has verified that the required conditions are fulfilled, to transmit an instruction to the machine concerned for reloading its down counter.

More generally, various systems exist allowing not only the transmission of a counter reload instruction from the center to one of the machines, but also the transmission of counter readings between that machine and the center. One of these systems makes provision for fitting each of the machines with a modem, the dialogue between the machine and the center being effected by means of the public telephone network using secure messages in both directions. Another system makes provision for the use of a portable object with a data memory protected by a logic access shell, an object which is transported between the center and the machine.

At the present time, these systems give complete satisfaction, in particular with regard to protection against fraud on counter reloading, since access to information transmitted between the center and the machine is prevented respectively by protecting the transmission over the public telephone network, or by the portable object logic access protection shell.

SUMMARY OF THE INVENTION

The invention aims to allow the transmission of information with the same degree of security as described above, but more economically.

To that end it proposes a method for transmitting information between a computerized control center and a plurality of electronic franking machines, at least in order that the center may transmit a counter reload instruction to each of the said machines, a method in which the data to be sent and received are respectively written to or read from a memory of a portable object which is transported between a means for writing data to be sent and a means for reading data to be received, with a said writing means controlled by the center and a said reading means provided for in each franking machine; characterized in that portable objects are used where the writing and reading of data in the memory are free, making provision, if information to be protected from fraud such as the said reload instruction is transmitted, for sending data having an authentication means, and using the data received only after verification of the authentication means, the latter being adapted for being capable of being prepared and verified only if secret information kept both in a secure memory at the center and in a secure memory in the machine with which the transmission is carried out is known.

It can be seen that the invention takes advantage of the fact that the computerized control centers and the electronic franking machines are already provided with means of protection against fraud, and in particular memories which are secure, that is to say with protected access, in a manner which allows the transmission to benefit from these already existing access securities, instead of making provision for additional securities specific to the transmission as in the aforementioned prior art systems.

The invention therefore enables the costs related to these additional securities to be avoided. In particular, as regards equipment, portable objects and means of writing and reading their memory are used which are particularly simple and economic on account of the writing and reading of the memory being completely free.

According to preferred characteristics of the invention:

when each said franking machine is put into service, an initialisation initializing phase is carried out in which a set of different random numbers is secretly allocated to it, loaded both into a secure memory at the center and into a secure memory on the machine, each secret number being kept therein in association with a two-state index set in a first state at that time;

in order to transmit a counter reload instruction to this machine, the center reads from its said secure memory one of the secret numbers allocated to that machine and whose index is in the first state, it sets the index associated with the secret number read into the second state, and writes the said secret number read into the memory of a said portable object; and when a franking machine detects the presence of a portable object in its reading means, it causes the latter to read the memory of the object, it looks to see whether the number appearing in the data which it has just received is one of the secret numbers kept in its secure memory, and if it finds this number there associated with an index in the first state, it sets the index into the second state, and reloads its counter.

Thus the authentication means which is included in the transmitted data is the secret number, that is to say an actual element of the secret information kept in secure memory.

The fact of making the indices associated with this number change to the second state allows its re-use to be avoided, which is necessary since the number may have been revealed to a third party, given that the portable object can be freely read.

Preferably, for reasons of simplicity, in the said initializing phase a single counter reload value is allocated to the machine, which it uses each time that it reloads its counter.

According to a more elaborate variant, provision is made in the said initializing phase for several series of different random numbers, to each of which a distinct counter reload value corresponds, the machine using the value corresponding to the series to which the secret number which it has just received belongs, when it reloads its counter.

According to other preferred characteristics:

when each of the said franking machines is put into service, an initializing phase is carried out in which it is given a set of secret numeric keys for an algorithm suitable for producing a cryptogram from data and such a numeric key, and these keys are loaded both into a secure memory at the center and into a secure memory on the machine;

in order to authenticate the origin of information sent by the center or by the said machine, one of the said secret numeric keys is chosen, the sender of the information calculates a cryptogram with this key and writes the information to be transmitted and the cryptogram into the memory of a said portable object, and when the addressee of the information detects the presence of a portable object in its reading means, it causes the latter to read the memory of the object, calculates a cryptogram with the same key, compares the cryptogram appearing in the received data with that which it has calculated, and considers the information authentic only if the received cryptogram and the calculated cryptogram match.

The transmitted data authentication means which is formed by the cryptogram is here not directly an element of the secret information, but it can be obtained only by access to the appropriate secret numeric key.

The use of such an authentication means is particularly well suited for example for authenticating counter readings from a machine, on the basis of which its user will be invoiced.

In such a case, the data with which the cryptogram is calculated may be characters appearing in the information sent or, particularly in the case where the information sent has relatively few characters, the data with which the cryptogram is calculated are randomly generated characters, which are also written into the memory of the portable object.

BRIEF DESCRIPTION OF THE DRAWINGS

The disclosure of the invention will now be continued by describing an example of an embodiment given below, as illustrative and non-limitative, with reference to the accompanying drawings, in which.

DETAILED DESCRIPTION

Figure 1:
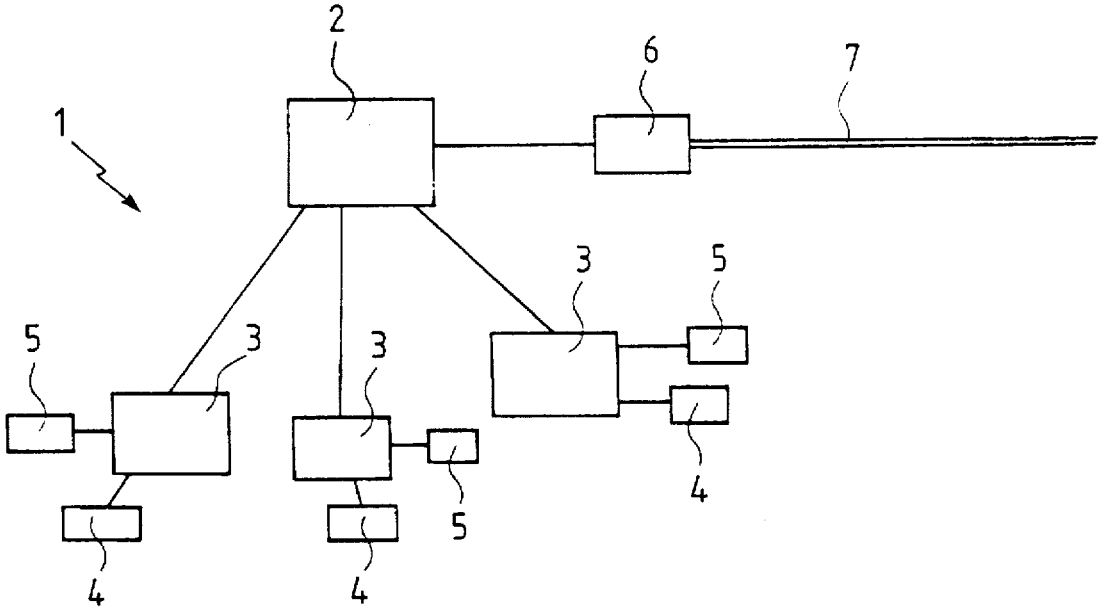
FIG. 1 shows diagrammatically a computerized control center having responsibility for a set of electronic franking machines, with which it communicates in accordance with the present invention.

The center 1 shown on FIG. 1 has a computer complex consisting of a server computer 2 to which are connected three management computers 3 to each of which is connected a chip card reader/encoder 4 and a label printer 5, a modem 6 directly linked to the computer 2 being connected to a telephone line 7 which is dedicated to it.

Figure 2:
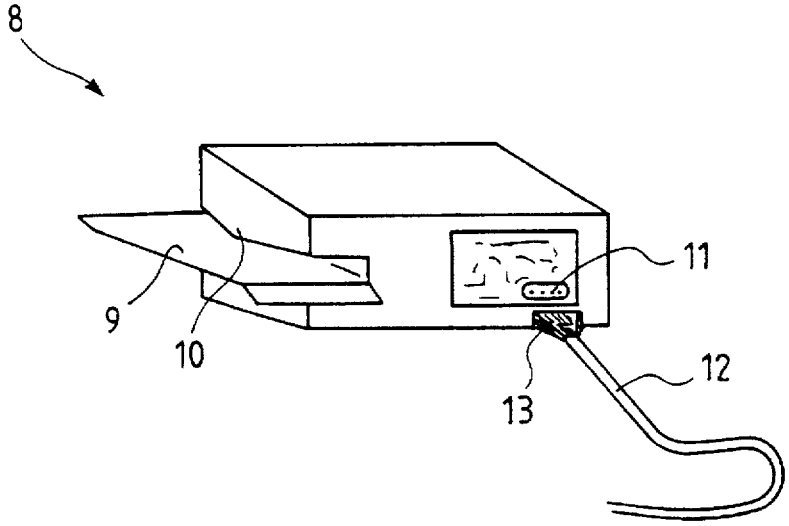
FIG. 2 is a diagrammatic perspective view of one of these franking machines, shown in an initializing phase.
Figure 4:
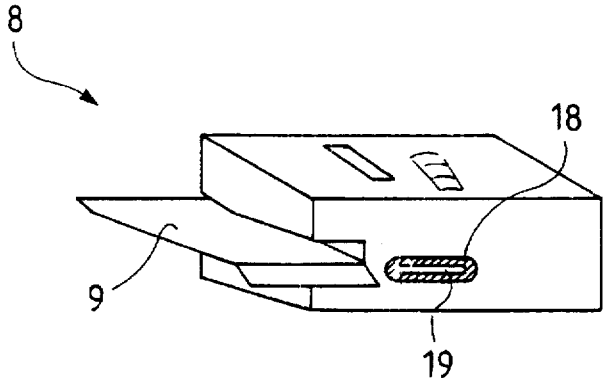
FIG. 4 is another perspective view of the franking machine illustrated in FIG. 2, showing the external part of its chip card reader/encoder.

The franking machine 8, shown in particular on FIGS. 2 and 4, has in a conventional fashion a tray 9 for guiding the object on which the franking is to be printed by a head 10 situated above the plate 9, and various other customary elements, not shown, in particular a keypad and a balance, and internal control and management circuits driven by a microcontroller provided with franking management software of a known type, corresponding for example to that described in French patent application 93-04694 belonging to the Applicant.

In addition to these conventional elements, the machine 8 has a connector 11 by means of which its internal circuits are accessed, in order to carry out an initializing operation by connecting these circuits to the computers at the center 1 using the cable 12, one end of which has a connector 13 suitable for cooperating with the connector 11, the other end of the cable 12 being connected directly to one of the computers at the center 1 when the initializing operation is carried out locally, or by means of a secure data transmission line when the operation is carried out remotely. In normal service, the connector 11 is shielded by a tamper-proof protective cover.

Figure 3:
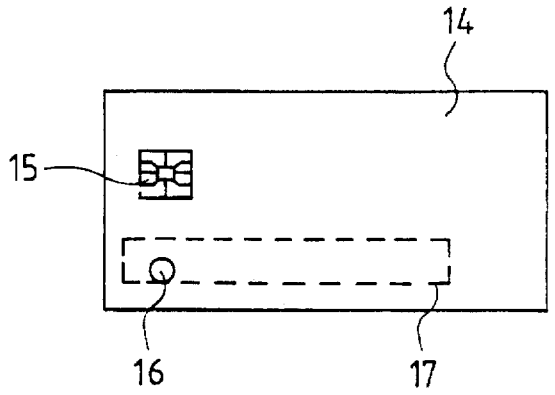
FIG. 3 is a plan view of the chip card which is used to transmit the information.

The machine 8 has yet more elements, described later, which enable it to cooperate with the chip card 14 shown in FIG. 3.

The format of this card, its connector 15 and the location of the latter are in accordance with those standardised by ISO. It is fitted with a microcircuit (not shown) of the non-volatile, re-writable RAM type, of the EEPROM kind, or equivalent. This microcircuit does not have any logic input protection, which means that the reading and writing of data on the card 14 are completely free.

In line with the connector 15, the card 14 has a hole 16 through its thickness, this hole being covered in certain cases, mentioned below, by a label printed with one of the printers 5 at the center 1, and stuck in the location shown on FIG. 3 by the frame 17 in broken lines.

Figure 5:
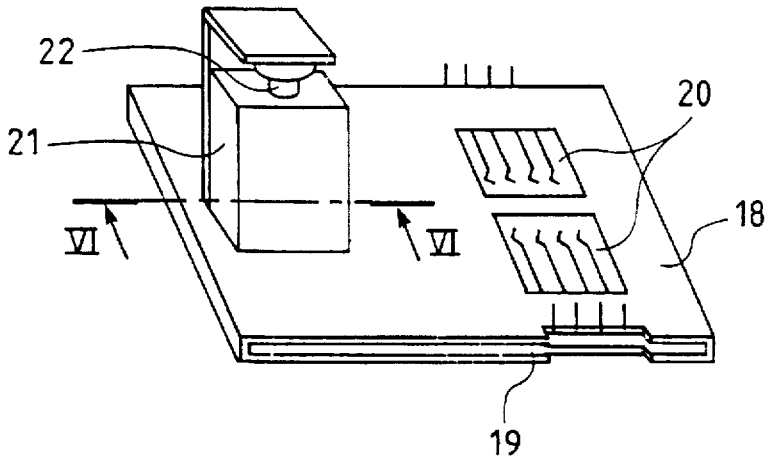
FIG. 5 is a perspective showing, enlarged in comparison with FIG. 4, the card reader/encoder receptacle and certain elements which are associated with it.
Figure 6:
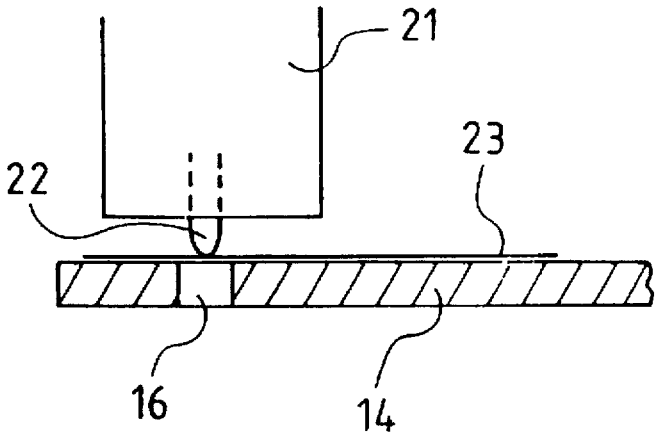
FIG. 6 is a partial elevation view in section along the plane marked VI—VI on FIG. 5.

As shown in FIGS. 4 to 6, the franking machine 8 has an element 18 for receiving the card 14, which opens to the outside through a slot 19, the receptacle 18 being associated, as shown in FIG. 5, with a two-part connector 20 which is activated when the card is fully pushed in, and an electromagnet 21 fitted with a plunger 22 terminating in a point (see FIG. 6), the plunger 22 being designed to pass through the hole 16 in the card 14 when activated, and therefore to perforate, at the position of the hole 16, any label 23 which may be stuck on the card 14 at the location 17.

In addition to the conventional franking management software mentioned above, the microcontroller driving the management and control circuits of the machine 8 is also provided with additional software which enables this same microcontroller to manage the various operations connected with the transmission of information carried out by means of the card 14, operations which will now be described.

In order to initialize the machine 8, a record is opened in the computers at the center 1, which includes the references of a user duly listed and authorized to use the machine, and a computer at the center 1 is linked to the connector 11 as indicated previously.

A set of different random numbers, for example 250 numbers of ten decimal digits, is secretly allocated to the machine 8, the number of the machine and the series of 250 numbers is recorded in the record at the center, and these same data are transmitted to the machine 8, which automatically records them on permanent (non-volatile) memories, each number being associated, whether this is in the record at the center or in the machine memories, with an index which may take at least the states zero and one, and which is set at this stage to the zero state. The file element of the 250 secret random numbers is recorded securely at the center 1 so that non-authorized personnel are not able to access them, even during maintenance operations.

During initializing, a value with which the down counter in the machine must be reloaded when the latter receives a reload instruction from the center is also recorded in the record at the center and in the machine 8.

When the initializing operation is complete, the machine 8 is again enclosed in its security cover, which is itself sealed with a tamper-proof seal, and the machine is ready to be put into service.

Once the machine 8 has been installed at the site where it is to be used, in order to function it needs to receive, via the card 14, an instruction for reloading its down counter, which is at zero.

This instruction is actually given by the reception of one of the 250 numbers contained in the memory registers of the machine 8, provided that it has not already been used.

In the embodiment of FIGS. 1 to 6, the issuing of the card 14 containing the instruction authorizing the reloading of the down counter is undertaken by the center 1.

For this, when authorization is requested from it by mail or telephone, after verification that the required conditions are fulfilled (payments of money made, or any other condition), the center uses one of the readers/encoders 4 to write in the memory of a card 14 a number of items of information intended to indicate the machine for which it is intended, in particular the number of that machine, and one of the secret numbers, not yet used (index at zero), from among the 250 which are allocated to that machine, the index of the number sent then being set to one to show that it has been used.

Moreover, using a printer 5, a self-adhesive label 23 is printed in clear with data identifying the machine for which the authorization is intended and, when the card 14 has been coded, this label is stuck to the location 17 where it blocks off the opening 16, this label being produced with a background printing which enables its origin to be recognized and limits the risks of it being replaced with fraudulent intent.

After having prepared the card 14 in this way, the center 1 dispatches it, for example by carrier or post, to the site where the machine 8 is located, and on reaching this site, the card 14 is inserted into the receptacle 18. The connectors 20 are activated when the card is fully pushed in. The data present on the card are read and sent to the internal circuits of the machine which check whether the identification number appearing in that match the identification number which was assigned to it in the initialisation phase. If this is indeed the case, the circuits operate the electromagnet 21 so that the plunger 22 descends then rises again, that is to say to make it move from its rest position where it is outside the space for receiving the card 14 which opens to the outside through the slot 19, to an activated position where it crosses this space, then to the rest position, in such a way that it perforates the label 23 at the position of the hole 16, the circuits investigate whether the number appearing in the data which have just been read is among the secret numbers kept in its memory registers, and if the machine finds this number there associated with an index at the zero state, it sets the latter to the one state, and reloads its down counter from the reload value which was allocated to it during the initializing operations.

The reload value may of course naturally vary from one machine to another, in view of anticipated consumption or any other consideration, but for a given machine it cannot be modified remotely.

As a variant, provision is made in the initializing phase for several series of different random numbers, each with a distinct corresponding counter reload value, the machine using the value corresponding to the series to which the secret number which it has just received belongs, when it reloads its counter.

In other variants, the same method is used for other counters controlling the use of the machine 8, for example for authorizing the machine to operate for a predetermined time, or for authorizing it to operate until the up counter has reached a value calculated by adding the reload value to the value which this counter had when reloading was carried out.

In view of the fact that re-use of a secret number is prevented, counter reloading, after initializing, can be carried out only a number of times equal to the quantity of secret numbers allocated during the initializing phase, which is 250 in the present example. In cases where the machine is still to be used, it is then necessary to carry out a fresh initializing operation.

In the preceding description of the example embodiment of FIGS. 1 to 6, it is the center 1 which is the sender of information to be transmitted, and the machine 8 which is the addressee or receiver of it, but it is also possible to have the machine 8 as sender and the center 1 as addressee, in particular in order to transmit to the latter a reading of the up counter or other data stored in the machine 8, for example statistics of use of the various franking blocks, the machine 8 transmitting the data to the center for example in response to a command written by the center on the card at the same time as the counter reload instruction.

Given that the card 14 may be written to freely, it is preferable to also make provision therein for a data authentication means, in order to be certain that the data read at the center 1 are indeed those which were written by the required machine 8.

Thus, for example, provision may be made that during the initializing phase of the machine 8, it is given a set of secret numeric keys for an algorithm suitable for producing a cryptogram from data and one of the keys in question, these being stored in the record which the center 1 holds for the machine 8, in its secure part, and in the memory registers of the machine 8. One of the secret keys being chosen, the machine calculates the cryptogram from the data which it is sending, and writes it on the card at the same time as the data. The center 1, after having read the data, re-executing the same calculation and verifying that the cryptogram which it obtains correctly matches that which is present on the card.

Naturally, in cases where the data might have been modified with a fraudulent aim, the absence of correspondence between the cryptograms would reveal the fraud.

In order to choose the key used for transmission, a first one may be determined for example during the initializing operations, and provision made for commands which the center can transmit to the machine 8 for the latter to use another of the keys which it keeps in memory.

Of course, the calculation of the authentication cryptogram is carried out by the internal electronic circuits of the machine 8, the algorithm being contained in the additional software with which the microcontroller is provided, this algorithm being for example of the DES type.

The ability to make the machine 8 return data to the center 1 may in particular be used to carry out, on command, as indicated above, reading of the up counter, in order to invoice the machines according to their actual consumption.

It may also serve to provide control of maintenance of the machines: for this, a card is issued by the center and sent to the organization responsible for maintenance. This card carries the number of the machine to be checked, and a deadline for carrying out the check. A technician must then go to the machine, insert the card in it, which will write the information required on the state of the said machine. Proof of the action will be given by the return of the card to the center 1.

It is also possible that the sender to be authenticated is the center 1. In this case, if it has no data to be transmitted or if they are insufficient in number, it generates a series of characters randomly, calculates the cryptogram on the basis of these, and writes both the series of characters and the cryptogram, the latter being verified on arrival by the machine 8.

Figure 7:
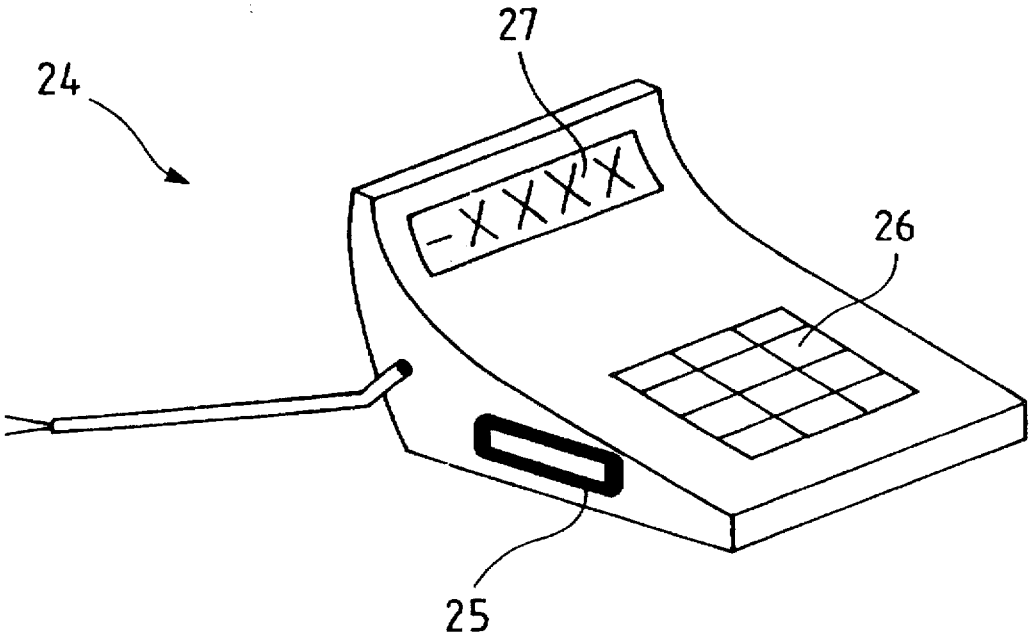
FIG. 7 is a diagrammatic perspective view illustrating diagrammatically a data communications terminal capable of being connected through the telephone network to the control center shown on FIG. 1.

In another embodiment, explained below with the help of FIGS. 1 and 7, it is not the readers/encoders 4 provided at the center 1 which are used by the latter to write or read information on the card 14, but the data communications terminal 24 shown on FIG. 7, which is present on a site where there are a number of machines 8, this site being remote from the center 1. The terminal 24 has in a single housing at least one chip card reader/encoder 25, of the same kind as the reader/encoder 4 in the center 1 or as the one which is provided in the machines 8 and which has a receptacle 18 for the card. In addition to the reader/encoder 25, the terminal 24 has logic control circuits and a modem, and possibly, as in the example shown in FIG. 7, a keypad 26 and a screen 27.

The logic control circuits are sensitive to the insertion of a card in the reader/encoder 25, recognize the type of card inserted and verify that the card contains the appropriate identification information. According to the information read on the card (see later), the control circuits may start the execution of a card read operation or a write operation, or automatically call the center 1 by means of the modem to request a transaction, to transmit information to the center or receive some from it.

On the site where the terminal 24 and the various machines 8 are located, provision is made for one card 14 per machine, the memory of which has the identification number of that machine through an initializing step carried out by the center 1, without the latter producing a label with the printer 5 nor sticking one to the location 17, and more generally, in the variant using the terminal 24, no label is stuck on the cards 14 used. Apart from this difference, the transmission of information is similar to that of the first embodiment apart from the fact that the reader/encoder 25 is connected to the computer 2 not by means of a management computer 3, but by means of the public telephone network 7 and the modem 6.

From the point of view of the user, whereas to obtain a counter load instruction when the card is issued by the center he must make a request by telephone, letter, fax or telex and wait for the card to be created by the center during its opening hours and finally sent to the site by post or carrier, the fact of having a data communications terminal 24 available enables a reload instruction to be obtained in a few moments and at any time.

To obtain such an instruction, the card belonging to the machine which needs it is inserted in the latter, the card being recognized, the machine 8 will record, on the card 14 belonging to it, its state, and in particular the value of certain of its counters, and the cryptogram for use.

The user then withdraws the card from the machine, and inserts it in the terminal. The latter recognizes the card, and calls the center using its modem, the communication passing through the public telephone network 7 and through the modem 6 of the center 1, the data transmitted being those which are written in the memory of the card 14.

After having received the data, the center 1 verifies their authenticity using the cryptogram, and if all conditions are fulfilled, it sends a message by return including the data to be written on the card to constitute a counter reload instruction, and in particular one of the 250 numbers still valid.

The user recovers the card from the terminal and again inserts it in the machine, which carries out the same operations as described above up to the reloading of its counter, it then being possible to write certain data onto the card so that the process repeats when it is again necessary to request another counter reload instruction.

Numerous variants are possible according to circumstances, and in this respect it should be stated that the invention is not limited to the examples described and depicted.

We claim:

1. A method for transmitting information between a computerized control center and a plurality of electronic franking machines, at least in order that the center may transmit a counter reload instruction to each of the said machines the method comprising the steps of:

keeping, for each machine of said plurality of machines, both in a secure memory in said center and in a secure memory in said each machine, a plurality of units of secret information each available for any future transmission of information from said center to said each machine, and transmitting information to be protected from fraud, such as said reload instruction, from said center to a determined machine of said plurality of machines, said step of transmitting including the substeps of, providing for a portable object having a memory in which writing and reading of data are free, selecting at said center a determined unit of information amongst said plurality of units kept for said determined machine, writing to said memory of said portable object with a writing means controlled by said center, data including an authentication means adapted to be prepared and verified only if said determined unit of information is known, transporting said portable object to said determined machine, reading said data from said memory of said portable object, with a reading means provided in said determined machine and taking into account said data in said determined machine only after verification of said authentication means.

2. The method of claim 1, wherein:

each unit of secret information includes a random number, each random number being kept in said secure memory in said center in association with a two-state index set in a first state at a time of initializing a franking machine; and to transmit a counter reload instruction to a give machine, the center reads from its said secure memory one of the secret numbers allocated to that machine and whose index is in the first state, it sets the index associated with the secret number read into the second state, and writes the said secret number read into the memory of a said portable object; and when a franking machine detects the presence of a portable object, reads the memory of the object, looks to see whether the number appearing in the data which it has just received is one of the secret numbers kept in its secure memory, and if it finds this number there associated with an index in the first state, it sets the index into the second state, and reloads its counter.

3. The method of claim 2, wherein a single counter reload value is allocated to the machine in initializing a franking machine, which value is used each time that franking machine reloads its counter.

4. The method of claim 2, wherein when initializing a franking machine a distinct counter reload value is associated with each of said plurality of secret random numbers, the franking machine using the counter reload value corresponding to the secret number which it has just received belongs, when it reloads its counter.

5. The method of claim 1, wherein each of said plurality of sets of information comprise a secret numeric key for an algorithm suitable for producing a cryptogram from data and such a numeric key; and in order to authenticate the origin of information sent by the center or by one of said franking machines, one of the said secret numeric keys is chosen, the sender of the information calculating a cryptogram with this key and writing the information to be transmitted and the cryptogram into the memory of a said portable object, the addressee of the information detecting the presence of a portable object, reading the memory of the object calculating a cryptogram with the same key, comparing the cryptogram appearing in the received data with that which it has calculated, and treating the information as authentic only if the received cryptogram and the calculated cryptogram match.

6. The method of claim 5, wherein the data with which the cryptogram is calculated are characters appearing in the information sent.

7. The method of claim 5, wherein the data with which the cryptogram is calculated are randomly generated characters, which are also written into the memory of the portable object.

8. The method of claim 1, wherein the center controls a means for writing/reading in the memory of the portable object, and in that each said franking machine has a means for writing/reading in the memory of the portable object.

9. In the method of claim 8, characterised in that at least one writing/reading means controlled by the center is part of a data communications terminal placed at a site where said franking machine is located, the said terminal having means for being linked to the center through a public telephone network.

10. The method of claim wherein the said portable object is a chip card.

* * * * *

UNITED STATES PATENT AND TRADEMARK OFFICE

CERTIFICATE OF CORRECTION

PATENT NO. : 5,675,651

DATED : Oct. 7, 1997

INVENTOR(S) : Jean-Philippe Bailleux, et al

It is certified that error appears in the above-identified patent and that said Letters Patent is hereby corrected as shown below:

| Column | Line | |
|---|---|---|
| 5 | 50 | After "that" insert --data--. |
| 6 | 31 | After "center" insert --1--. |
| 8 | 64 | Change "give" to --given--. |
| 9 | 19 | Delete "belongs". |
| 10 | 2 | After "object" (2nd occurrence) insert --,-- |
| 10 | 26 | After "claim" insert --1--. |

Signed and Sealed this

First Day of December, 1998

*Attest:*

*Attesting Officer*

BRUCE LEHMAN

*Commissioner of Patents and Trademarks*